United States Patent [19]

Folsom

[11] Patent Number: 5,014,971

[45] Date of Patent: May 14, 1991

[54] WEB KNICKER

[75] Inventor: James C. Folsom, Sanford, Me.

[73] Assignee: Moore Business Forms, Inc., Grand Island, N.Y.

[21] Appl. No.: 488,951

[22] Filed: Mar. 5, 1990

[51] Int. Cl.[5] ..... B41L 1/32

[52] U.S. Cl. ..... 270/039; 270/30; 493/357; 493/411; 493/414; 225/96.5; 83/29

[58] Field of Search ..... 270/30, 31, 39; 493/357, 358, 359, 401, 411, 414, 415; 83/29; 225/96.5, 2

[56] References Cited

U.S. PATENT DOCUMENTS

| | | | |
|---|---|---|---|
| 4,205,836 | 6/1980 | Nystrand | 493/357 |
| 4,623,136 | 11/1986 | Bunch Jr. | 270/39 |
| 4,650,447 | 3/1987 | Meschi | 493/357 |
| 4,915,644 | 4/1990 | Bunch Jr. | 493/357 |

OTHER PUBLICATIONS

B. Bunch Company Procedural Manual, Oct. 1983.

*Primary Examiner*—John T. Kwon

*Assistant Examiner*—Therese M. Newholm

*Attorney, Agent, or Firm*—Nixon & Vanderhye

[57] ABSTRACT

In a conventional Bunch folder having a swing chute, beaters, spirals mounted for rotation about vertical axes, and a reciprocal cutting blade, a cut initiating device is provided. The cut initiating device initiates a cut (forms a knick) at the edge of a perforation between adjacent business forms to be severed from each other, so that the cutting blade may easily sever the forms completely at the perforation. The cut initiating device comprises a short horizontally extending blade mounted by a collar to a shaft of the spiral adjacent the cutting blade start position so that the blade is rotatable with the spiral for engaging the folding web at a perforation and forming a 1/16 to ½ inch cut in the perforation at an edge. The blade may have a horizontal cutting edge portion, a cantilevered portion at a different level than the cutting edge portion and a step portion interconnecting the cutting and cantilevered portions. A knick in the edge is formed at first predetermined intervals (e.g. every other fold perf), while complete severing by the reciprocal blade is practiced every 100 forms or so.

20 Claims, 2 Drawing Sheets

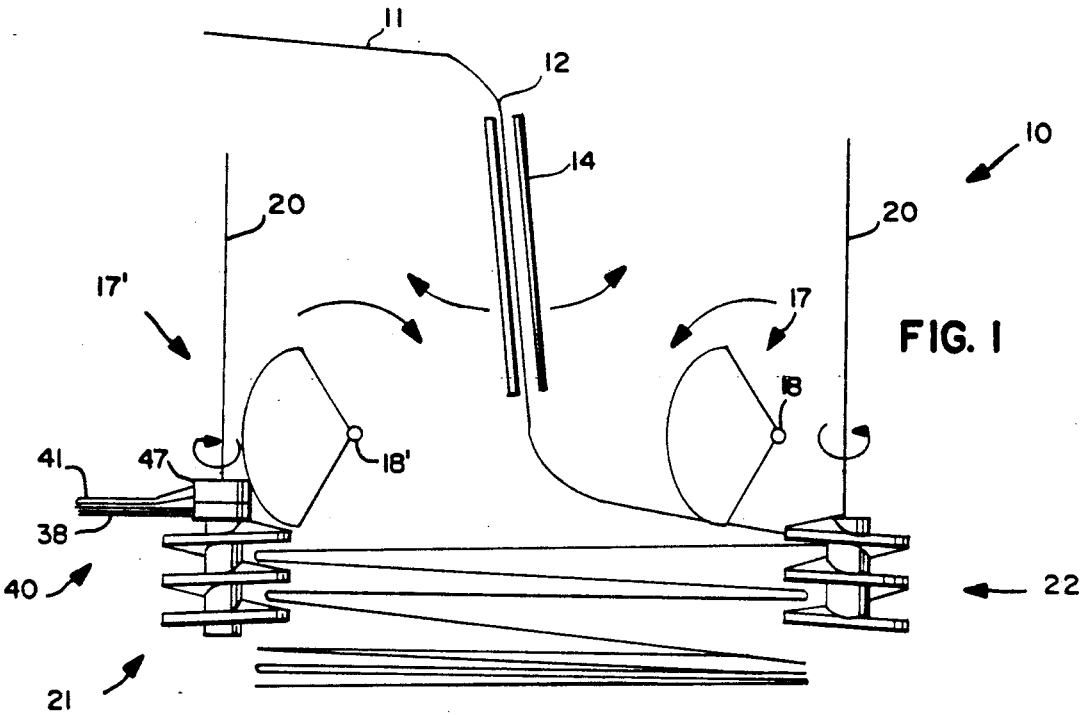
FIG. 1
FIG. 2
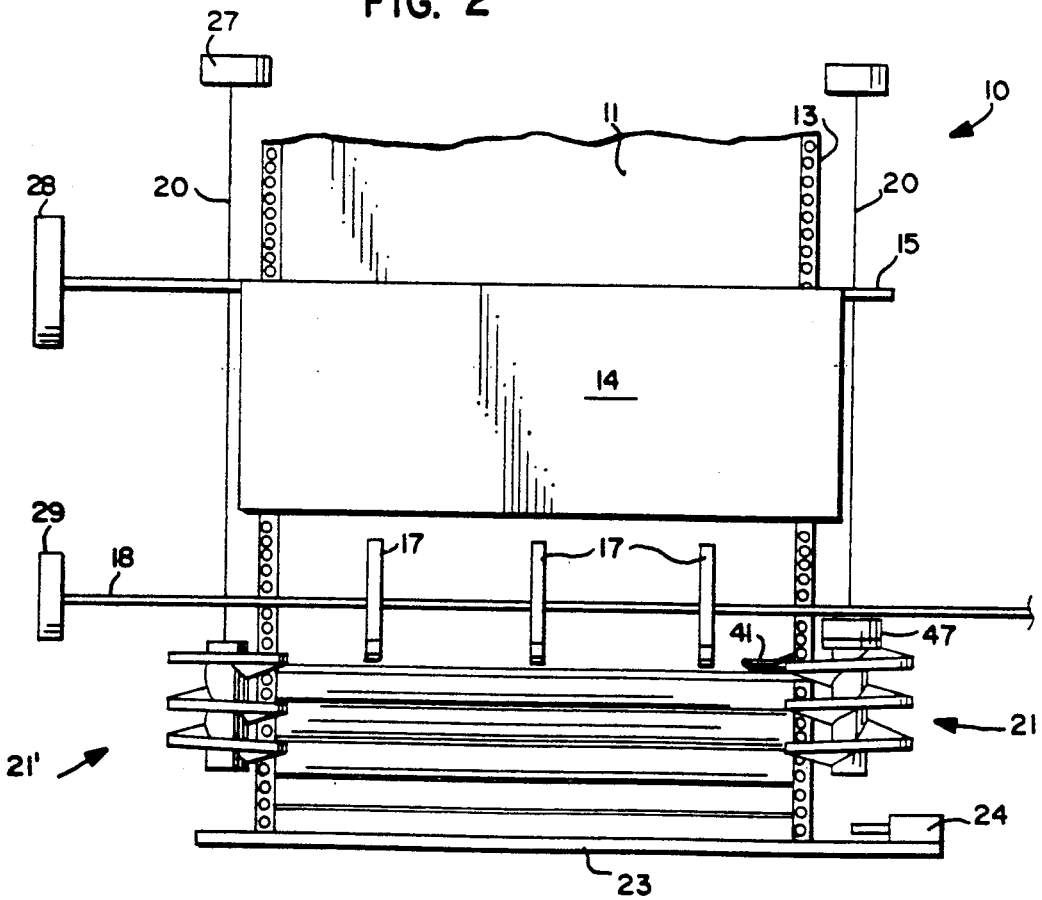

WEB KNICKER

BACKGROUND AND SUMMARY OF THE INVENTION

A very useful automatic folder for folding a continuous web of perforation connected business forms is known as the Bunch folder manufactured by B. Bunch Company of Phoenix, Ariz. In the normal operation of the Bunch folder, the web enters a swing chute at the top, and comes out the bottom, the swing chute being oscillated to lay down the continuous web of business forms in a festooning, manner, the forms being folded at the perforation lines between individual forms. Beaters on opposite sides of the swing chute direct the web of paper into spirals that are rotatable about horizontal axes. Four spirals are provided, one on each corner of the web being folded, with the spirals diagonally across from each other turning in the same direction, and guiding the edge of the web as it is being folded. It is desirable to sever the continuous web along a perforation a predetermined number of forms that have been stacked (e.g. every 100, 200 or 500 forms, etc.) for packaging or use. This is accomplished by mounting a knife on a knife traveler rod, the knife starting at one end of the web adjacent one of the spirals, and when action thereof is initiated, engaging the edge of the web at a perforation and cutting along the perforation.

While the Bunch folder is a very useful folder, there have been significant difficulties associated with the severing action by the knife. According to the invention, it has been found that the knife has difficulty in severing the web at the perf because the knife has difficulty breaking the edge of the web. The knife moves transversely to the web edge which accounts for its difficulty in breaking the edge. It was sought to remedy this by knicking (that is initiating a cutting) a marginal edge of the web during the manufacture or printing process, but it was found impossible to hold the web in sufficiently close alignment to effect a knick (e.g. a 1/16 inch cut) in the edge.

According to the present invention, it is possible to remedy the problems associated with the web severing of the Bunch folder. This is simply and effectively accomplished according to the present invention by initiating a cut at a perforation coincident with or immediately after folding, by moving a cut initiating blade in an arc so that it need not engage the edge of the web, but comes between adjacent forms that are folded at a perforation and engages the longitudinal axis of the perforation at the edge of the web. This is most desirably accomplished, according to the invention, by mounting a short knife blade so that it ends horizontally from the pre-existing spiral that is adjacent the knife blade at its cut-initiating point.

According to one aspect of the present invention, apparatus for folding a web of continuous business forms interconnected by perforations, and occasionally separating the continuous web at a perforation between adjacent forms, is provided. The apparatus comprises: a swing chute mounted for oscillating movement about a generally horizontal pivot, for receipt of a web of continuous business forms therein; a plurality of beaters mounted for rotation about a horizontal axis to engage the web when it exits the swing chute; a plurality of spirals mounted for rotation about vertical axes and adjacent the beaters and swing chute, for receipt of the edges of the web after engagement by the swing chute and/or beaters; cutting means for selectively cutting the web along a perforation between adjacent forms to sever the adjacent forms from each other; and cut initiating means for initiating a cut at the edge of a perforation between adjacent forms to be severed from each other, so that said cutting means may easily completely sever the forms at the perforation. The cut initiating means preferably comprises a short horizontally extending blade and means—such as a collar—for mounting the blade to one of the spirals and rotatable therewith. The blade may be formed so that it has a horizontal cutting portion, a horizontal cantilevered portion at a different level than the cutting portion, and a stepped portion interconnecting the cutting and cantilevered portions.

According to another aspect of the present invention, there is provided, per se, a web engaging structure for engaging the edge of a web and initiating a cut in the fold line of the web (preferably along a perforation). The structure comprises: a generally cylindrical body elongated in the dimension of a cylindrical axis, and having a top and a bottom at opposite ends of the body; a spiral having flights extending in a spiral around the body, with spacing between the flights sufficiently large for a web to be received therebetween; a short blade for initiating a cut in a web; and means for mounting the blade to the cylindrical body at the top thereof so that it extends above the cylindrical body, and generally perpendicular to the cylindrical axis. The means for mounting the blade to the cylindrical body comprises a collar attached to the uppermost portion of the cylindrical body. A brush also may be provided with the cylindrical body extending generally transverse to the cylindrical axis and adjacent the top of the cylindrical body, above the spiral.

The invention also contemplates a method of separating a web of continuous business forms in which individual forms are connected together by perforations. The method comprises the steps of: (a) effecting folding of the web in a festooning manner at the perforations therebetween to provide a stack of interconnected forms; (b) initiating a cut at the edge of a web perforation between adjacent forms at first predetermined intervals coincident with or immediately after the folding action; and (c) completing severing of the cut-initiated perforation between adjacent forms at second predetermined intervals coincident with, or immediately after, the folding action. While the first and second predetermined intervals may be the same, preferably a first interval has every other fold perforation, and a second interval is much greater than every other fold perforation (e.g. every 100, 200, or 500 forms, etc.). The cut that is effected in step (b) is between about 1/16 to ½ inch long.

It is a primary object of the present invention to provide for the effective occasional severing of continuous business forms during folding thereof. This and other objects of the invention will become clear from an inspection of the detailed description of the invention and from the appended claims.

BRIEF DESCRIPTION OF THE DRAWINGS

FIG. 1 is a schematic right side view of a conventional Bunch folder utilizing the web knicker according to the present invention;

FIG. 2 is a front schematic view of the apparatus of FIG. 1;

DETAILED DESCRIPTION OF THE DRAWINGS

Figure 3:
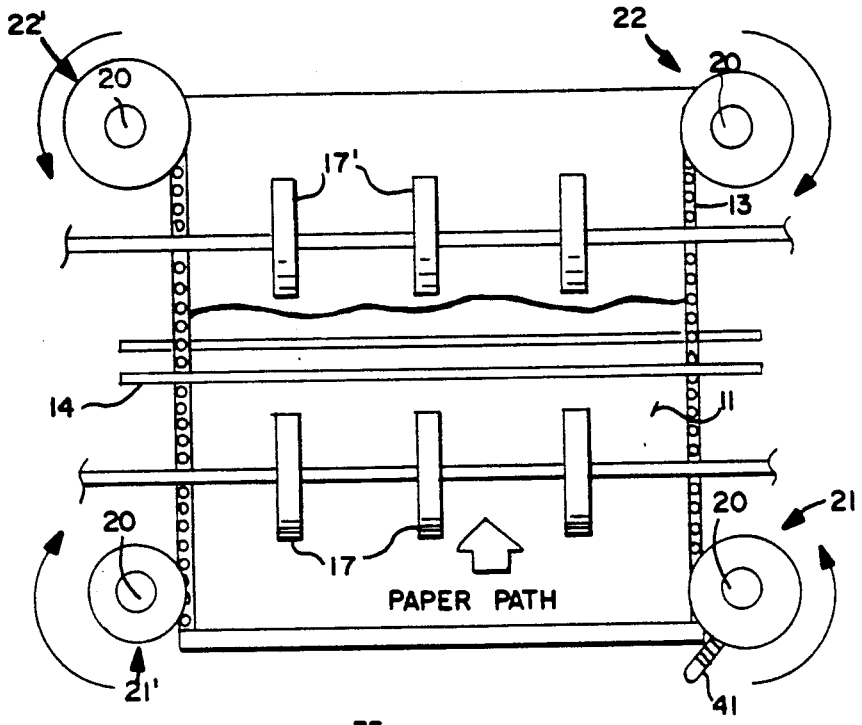
FIG. 3 is a top schematic view of the apparatus of FIGS. 1 and 2.

A Bunch folder which has been modified according to the invention is illustrated generally by reference numeral 10 in FIGS. 1 through 3. A continuous web of business forms having perforations 12 separating the individual forms, and tractor drive side edges 13, is fed into the top of a swing chute 14 mounted for oscillation about a shaft 15 defining a horizontal axis. As the web 11 exits the bottom of the swing chute 14, it is acted upon by beaters 17, 17' mounted for rotation about horizontal axes defined by the shafts 18, 18'. The beaters 17, 17' are 180° out of phase with each other and turn in opposite directions to bend the paper of the web 11 and direct it into spirals 21, 21', 22, 22' mounted for rotation about vertical axes defined by shafts 20. The spirals 21, 21', 22, 22' are mounted at the four corners of the web 11 being folded, with the spirals diagonally across from each other turning in the same direction so that spirals on either side of the web 11 turn into the center. No two spirals are identical. The diameters of diagonal spirals are different, with the spirals in the front of the machine being smaller in diameter.

A conventional Bunch folder also includes a cutting knife traveler rod 23 extending generally horizontally below the spirals 21, 21', 22, 22' with a knife blade 24 mounted thereon. Upon initiation of a power source, a knife blade 24 moves leftward (as illustrated in FIG. 2) to sever the web at a perforation 12 between adjacent forms, and then returns to the right side. Knife cutting action is initiated every predetermined number of webs in order to provide festooning action of the forms into a stack of a desired size (e.g. every 100, 200, or 500 forms or the like). The mechanisms 27, 28, 29 are the drive elements for the shafts 20, 15, and 18, 18', preferably being driven by belts.

Figure 4:
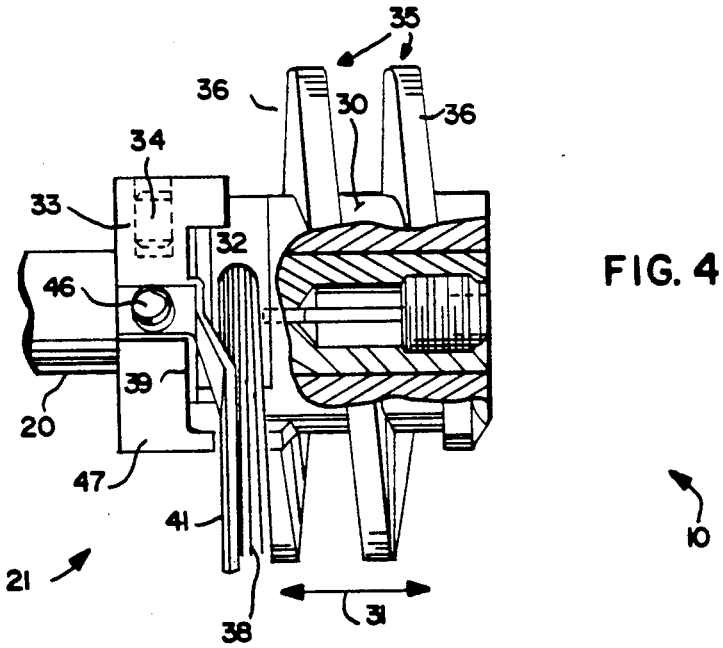
FIG. 4 is a side view, partly in cross section and partly in elevation, of a spiral with web knicker according to the present invention.
Figure 5:
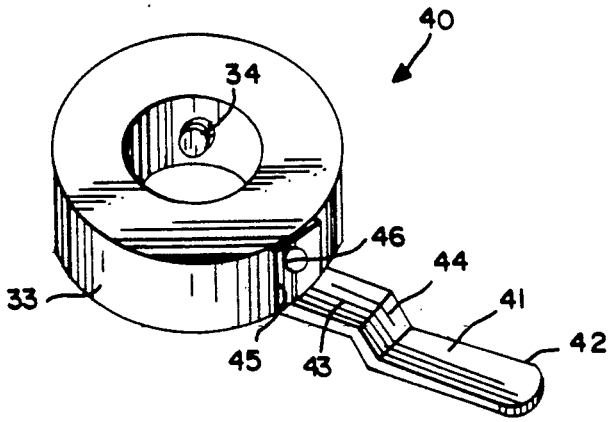
FIG. 5 is a top perspective view of an exemplary web knicker according to the invention.

The spiral 21 is shown in detail in FIG. 4. It includes a cylindrical body 30 elongated in a dimension of the elongation 31, concentric with the shaft 20. A key 32 or the like interconnects the cylindrical body 30 to the shaft 20, and a collar 33 is provided at the top of the body 30 to support the web knicker blade having a set screw 34 that may be tightened into engagement with the shaft 20 to hold the collar 33 in place. A spider roll 35 is provided having flights 36 extending in a spiral around the body 30, with spacing between the flights sufficiently large for a web edge to be received therebetween. Preferably, a brush 38 also is provided which is nested in the spiral, upward vertical travel being prohibited by an E-ring 39. The brush extends generally transverse to the cylindrical axis of the cylinder 30 and shaft 20, above the spiral 35.

What has been described heretofore is conventional for a Bunch folder (except the collar supporting a web knicker blade). According to the invention there is provided a cut initiating means for initiating a cut at a fold line of the web 11, preferably at a perforation 12, between adjacent forms, so that the cutting blade 24 may easily penetrate the edge of the web 11, and completely sever adjacent forms from each other along a perforation 12. A cut initiating means is illustrated generally by reference numeral 40 in the drawings and includes a short blade 41 having a cutting edge 42 and a cantilever portion 43, with a step portion 44 interconnecting the blade 41 and cantilever 43 so that they are at different horizontal levels. An upturned flange end 45 on the opposite side of the cantilever portion 43 from the blade 41 is connected by a fastener 46 to collar 33 for mounting the blade to the shaft 20. The blade 41 is mounted to rest on a horizontal plane located near the center of the brush bristles' horizontal plane. The blade 41 rotates with the spiral 21 counterclockwise so that the blade edge 42 enters between adjacent forms of the web 11 at a fold line (at perforation 12), and makes a knick of between about 1/16 and ½ inch at the edge of the web 11, adjacent the start position of the knife 24.

Note that the blade 41 will form a knick in the edge of the web 11 at a first predetermined interval, which—in the embodiment illustrated in the drawings and described above—will be every other fold (every revolution of the spiral 21). The knicking action is coincident with, or immediately after, folding. While the cutting action with blade 24 may be as frequent as a first interval (e.g. every fold line), typically it would be at a second interval much greater than the first interval (e.g. every 100, 200, or 500 forms, etc.).

Operation of the device 10, according to the invention, is simple and effective. The web 11 travels through the swing chute 14, is acted upon by the beaters 17, 17' so that it is folded at the perfs 12, and the edges of the web 11 enter between spiral flights 36 of the spirals 21, 21', 22, 22', so that the web 11 is formed into a stack of business forms. As the spiral 21 rotates, the blade 41 engages every other perf, forming a 1/16 to ½ inch knick at the edge thereof adjacent the starting point of the cutting blade 24. When desired, initiation of the cutting action is effected by moving the cutting blade 24 to the left (in FIG. 2) along the knife traveler rod 23, completing severing of the web 11 at that particular perf 12, so that the forms are in a stack given number (e.g. 100) high.

It will thus be seen that according to the present invention effective cutting action of continuous business forms during folding is provided, by providing cut initiation at the edge of the perforation between adjacent forms. The apparatus and method of the invention are extremely simple and straight forward yet effective, remedying the problems associated with a conventional Bunch folder. While the invention has been herein shown and described in what is presently conceived to be the most practical preferred embodiment thereof, it will be apparent to those of ordinary skill in the art that any modifications may be made thereof within the scope of the invention, which scope is to be accorded the broadest interpretation of the appended claims so as to encompass all equivalent structures and methods.

What is claimed is:

1. Apparatus for folding a web of continuous business forms interconnected by perforations, and occasionally separating the continuous web at a perforation between adjacent forms, comprising: a swing chute mounted for oscillating movement about a generally horizontal pivot, for receipt of a web of continuous business forms therein; a plurality of spirals mounted for rotation about vertical axes adjacent said swing chute, for receipt of the edges of the web after engagement by the swing chute; cutting means for selectively cutting the web along a perforation between adjacent forms to sever the adjacent forms from each other; and cut initiating means for initiating a cut at the edge of a perforation between adjacent forms to be severed from each other so that said cutting means may easily completely sever the forms at the perforation.

2. Apparatus as recited in claim 1 wherein said cut initiating means comprises a short horizontally extending blade, and means for mounting said short blade to one of said spirals and rotatable therewith for engaging the folding web at a perforation and forming a cut in the perforation at an edge thereof.

3. Apparatus as recited in claim 2 wherein said short blade mounting means comprises a collar mounted to said spiral at the uppermost portion thereof.

4. Apparatus as recited in claim 3 wherein said short blade has a generally horizontal cutting portion, a generally horizontal cantilever portion at a different level than said cutting portion, and a step portion interconnecting said cutting and cantilever portions.

5. Apparatus as recited in claim 2 wherein said cutting means comprises a cutting knife mounted on a knife travelling rod extending generally horizontally between a pair of said spirals, and mounted for cooperation with said cut initiating means for engaging a cut initiated perforation to effect complete severing thereof.

6. Apparatus as recited in claim 5 wherein said spiral to which said cut initiating means is connected also includes a brush.

7. A web engaging structure for engaging the edge of a web and initiating a cut in a fold line of the web, comprising:

a generally cylindrical body elongated in the dimension of a cylindrical axis, and having a top and a bottom at opposite ends of the body;

a spiral having flights extending in a spiral around said body, with spacing between the flights sufficiently large for a web to be received therebetween;

a short blade for initiating a cut in a web; and means for mounting said blade to said cylindrical body at the top thereof so that it extends in a generally horizontal plane, generally perpendicular to said cylindrical axis.

8. A structure as recited in claim 7 wherein said means for mounting said blade to said cylindrical body comprises a collar attached to a shaft and separated from said cylindrical body by an E-ring.

9. Apparatus as recited in claim 8 wherein said short blade has a generally horizontal cutting portion, a generally horizontal cantilever portion at a different level than said cutting portion, and a step portion interconnecting said cutting and cantilever portions.

10. Apparatus as recited in claim 7 wherein said short blade has a generally horizontal cutting portion, a generally horizontal cantilever portion at a different level than said cutting portion, and a step portion interconnecting said cutting and cantilever portions.

11. A structure as recited in claim 7 further comprising a brush, and means for mounting said brush so that it extends in a generally horizontal plane transverse to said cylindrical axis, and adjacent the top of said cylindrical body, above said spiral, said blade in a horizontal plane located near the center of the brush horizontal plane.

12. A structure as recited in claim 10 further comprising a brush, and means for mounting said brush so that it extends in a generally horizontal plane transverse to said cylindrical axis, and adjacent the top of said cylindrical body, above said spiral, said blade in a horizontal plane located near the center of the brush horizontal plane.

13. A structure as recited in claim 9 further comprising a brush, and means for mounting said brush so that it extends in a generally horizontal plane transverse to said cylindrical axis, and adjacent the top of said cylindrical body, above said spiral, said blade in a horizontal plane located near the center of the brush horizontal plane.

14. A method of severing a web of continuous business forms in which individual forms are connected together by perforations, comprising the steps of:

(a) effecting folding of the web in a festooning manner at the perforations therebetween to provide a stack of interconnected forms;

(b) initiating a cut at the edge of a web perforation between adjacent forms at first predetermined intervals coincident with or immediately after the folding action; and (c) completing severing of the cut-initiated perforation between adjacent forms at second predetermined intervals coincident with, or immediately after, the folding action.

15. A method as recited in claim 14 wherein said first and second predetermined intervals are the same.

16. A method as recited in claim 14 wherein said first predetermined interval is every other fold perforation, and said second predetermined interval is greater than every other fold perforation.

17. A method as recited in claim 14 utilizing a spiral rotatable about a vertical axis with horizontally extending short blade connected thereto, and wherein step (a) is effected in part by engaging edges of the web between flights of the spiral; and wherein step (b) is effected by the blade engaging the edge of a perf immediately after release by the spiral, by rotation of the spiral.

18. A method as recited in claim 17 wherein step (c) is practiced by reciprocating a knife blade horizontally, the knife blade engaging the cut initiated by step (b).

19. A method as recited in claim 14 wherein step (c) is practiced by reciprocating a knife blade horizontally, the knife blade engaging the cut initiated by step (b).

20. A method as recited in claim 14 wherein step (b) is practiced to initiate a cut of about 1/16 inch.

* * * * *